US005321860A

United States Patent [19]

Steinhardt et al.

[11] Patent Number: 5,321,860

[45] Date of Patent: * Jun. 21, 1994

[54] SHOWER ENCLOSURE ASSEMBLY

[75] Inventors: Michael D. Steinhardt, Kiel; Kathleen S. DeKeyser, Hingham; Kenneth J. Sieth, Cedarburg, all of Wis.

[73] Assignee: Kohler Co., Kohler, Wis.

[ * ] Notice: The portion of the term of this patent subsequent to Apr. 5, 2011 has been disclaimed.

[21] Appl. No.: 790,275

[22] Filed: Nov. 8, 1991

[51] Int. Cl.[5] ..... A47K 3/22

[52] U.S. Cl. ..... 4/601; 4/615; 220/477; 16/272; 16/364

[58] Field of Search ..... 4/567, 570, 597, 601, 4/605, 614, 615, 670; 239/282, 283; 312/248; 137/360; 220/4.22, 338, 343, 477, 478, 479; 16/271, 272, 362, 364

[56] References Cited

U.S. PATENT DOCUMENTS

| | | | |
|---|---|---|---|
| 722,624 | 3/1903 | Pickop | 16/271 |
| 1,143,218 | 6/1915 | McLane et al. | 16/272 |
| 1,357,740 | 11/1920 | Stephan | 16/364 X |
| 2,392,997 | 1/1946 | Prentice | 16/271 X |
| 2,697,839 | 12/1954 | Jackson | 4/601 X |
| 3,333,284 | 8/1967 | Symmons | 4/670 |
| 3,801,019 | 4/1974 | Trenary et al. | 239/444 X |
| 3,827,088 | 8/1974 | Arnold et al. | 4/570 |
| 3,924,808 | 12/1975 | Cooley, Jr. | 4/605 X |
| 4,177,927 | 12/1979 | Simmons | 4/615 X |
| 4,274,400 | 6/1981 | Baus | 4/615 X |
| 4,339,833 | 7/1982 | Mandell | 4/542 |
| 4,397,050 | 8/1983 | Davis et al. | 4/601 |
| 4,554,690 | 11/1985 | Knapp et al. | 4/601 |
| 4,563,780 | 1/1986 | Pollack | 4/597 X |
| 4,654,900 | 4/1987 | McGhee | 4/670 |
| 4,826,079 | 5/1989 | Przystawik | 239/19 |
| 4,942,896 | 7/1990 | Slusser | 137/360 |
| 4,944,457 | 7/1990 | Brewer | 239/242 |
| 5,035,010 | 7/1991 | Sakamoto et al. | 4/567 |
| 5,073,996 | 12/1991 | Schinle | 4/601 |

FOREIGN PATENT DOCUMENTS

| | | | |
|---|---|---|---|
| 2651814 | 3/1991 | France | 4/614 |
| 2-98791 | 8/1990 | Japan | 4/601 |

OTHER PUBLICATIONS

Three page advertisement from Hansgrohe, titled "Der Showertower" (no date).

*Primary Examiner*—Robert M. Fetsuga
*Attorney, Agent, or Firm*—Quarles & Brady

[57] ABSTRACT

An enclosure support for fluid nozzles in a shower facility wherein there are linkage members for oscillating the nozzles as well as an oscillating member for effecting oscillation with the linkage members and the oscillating member being connected to the support wall which is hinged for connection to a wall member. The hinging member allows for complete access to the back of the support wall without detachment from the wall. In another embodiment, there are fluid nozzles which are attached to a pulsating member with the pulsating member attached to the support wall which is hinged to allow access to the pulsating member at the back of the support wall. Alternatively, the support wall can have connected thereto both the linkage members, the oscillating member, as well as the pulsating member.

12 Claims, 4 Drawing Sheets

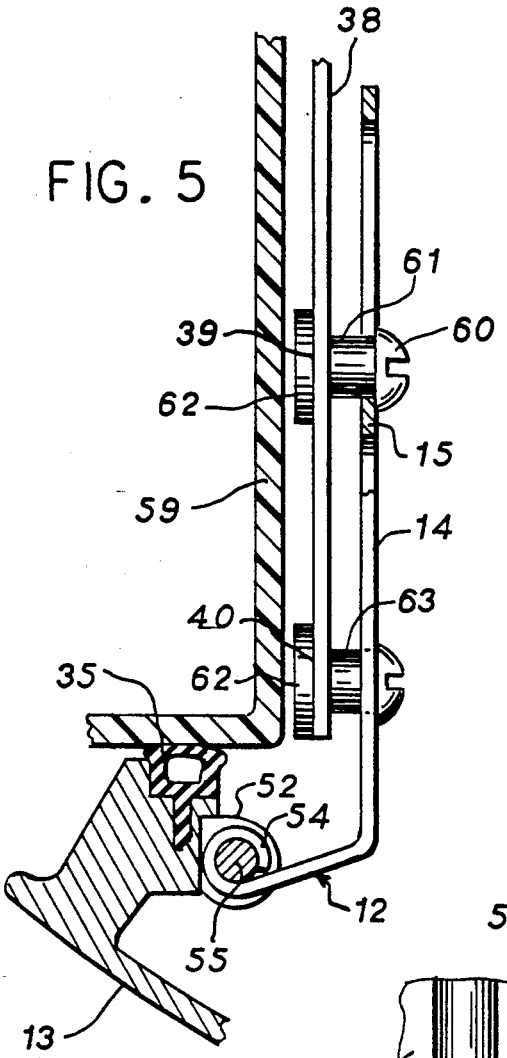
FIG. 5
FIG. 6
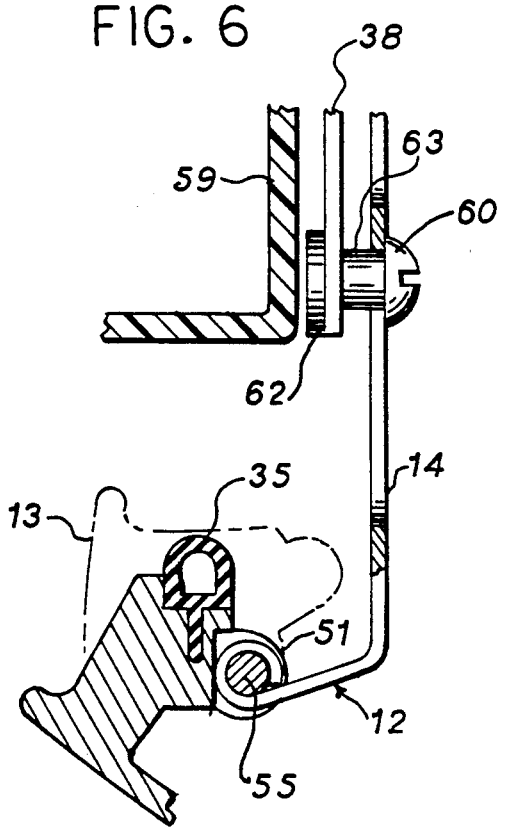
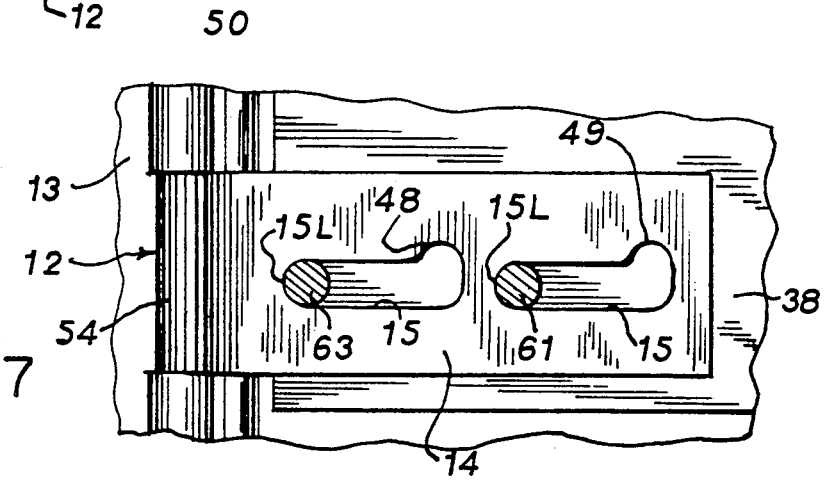
FIG. 7
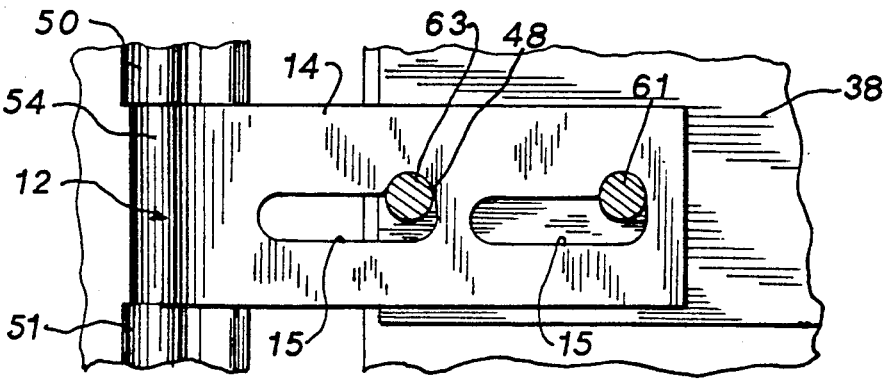
FIG. 8

SHOWER ENCLOSURE ASSEMBLY

BACKGROUND OF THE INVENTION

A. Field of the Invention

This invention relates primarily to showers. More particularly, the invention relates to an enclosure panel for a shower wherein nozzles and other apparatus for oscillating and delivering water to the nozzles can be connected to the enclosure panel and the panel hinged to a support for easy access.

B. Description of the Art

Recently designed showering facilities are employing multi spray outlets which can direct water over a larger area of a bather's body than is possible with a single frontal shower nozzle. In such instances, it is desirable to provide an oscillation of the multiple nozzles so as to increase the range of spray from the nozzles. It is also desirable to provide a pulsating of the water from the nozzles so as to accomplish a stimulating and hygienic body massage effect.

Providing the necessary equipment to accomplish the foregoing oscillation and pulsation presents a problem from both an installation and maintenance standpoint. For example, it would be advantageous not only to have the previously described equipment installed in a compact manner but also in a manner that the equipment is readily accessible for repair and maintenance purposes.

It is known in the art to provide a cover or extrusion which has a shower head wherein the cover can be removed for inspection or repair of the valve. This is shown in U.S. Pat. No. 3,333,284. It is also known to mount several spray heads on a panel with a pulsator. This is described in U.S. Pat. No. 4,397,050. However, there is not known in the art an enclosure panel which houses either an oscillating mechanism or a pulsator device wherein the panel is hinged for easy repair or maintenance of these mechanisms or devices.

SUMMARY OF THE INVENTION

In one aspect, the invention provides an enclosure support for oscillating fluid nozzles in a bathing facility. There is a support wall with one or more fluid nozzles. Two or more of the nozzles are pivotally attached to the support wall in a spaced manner. A fluid inlet means is connected to the fluid nozzles and oscillating means is attached to the support wall. Linkage means interconnects the oscillating means and the fluid nozzles. Pulsating means is attached to the support wall and is in fluid communication with the fluid inlet means. There are hinging means connected to the support wall for attachment to a supporting means such as a wall member.

In a preferred form, the hinging means are plate members and the support wall is an extrusion.

In one alternative embodiment, only the oscillating means is attached to the support wall and in another alternative embodiment only the pulsating means is attached.

In another preferred form, there are electric motors for driving the oscillating means and the pulsating means which are connected to the support extrusion.

The objects of the invention therefore include:

a. providing an enclosure support of the above kind which can support a multiplicity of shower devices and apparatus yet provide ready access thereto.

b. providing an enclosure of the above kind which is hinged to a supporting wall.

c. providing an enclosure of the above kind which can support oscillating and pulsator means as well as fluid spray nozzles.

d. providing an enclosure of the above kind which can be formed in various sizes and geometric configurations to fit various shower type installations.

e. providing an enclosure of the above kind which can support oscillating nozzles and mountings for oscillating linkage.

f. providing an enclosure of the above kind wherein the hinging means also provides a sliding action.

These and still other objects and advantages of the invention will be apparent from the description which follows. In the detailed description below, the preferred embodiments of the invention will be described in reference to the accompanying drawings. These embodiments do not represent the full scope of the invention. Rather the invention may be employed in other embodiments. Reference should therefore be made to the claims herein for interpreting the breadth of the invention.

BRIEF DESCRIPTION OF THE DRAWINGS

FIG. 5 is a view in partial horizontal section illustrating the shower enclosure assembly in a closed position.

FIG. 6 is a view similar to FIG. 5 showing the shower enclosure assembly in an open position.

FIG. 7 is a partial view in side elevation showing a plate member of a hinge in a closed position.

FIG. 8 is a view similar to FIG. 7 except showing the plate member in an open position.

BRIEF DESCRIPTION OF THE PREFERRED EMBODIMENTS

Figure 1:
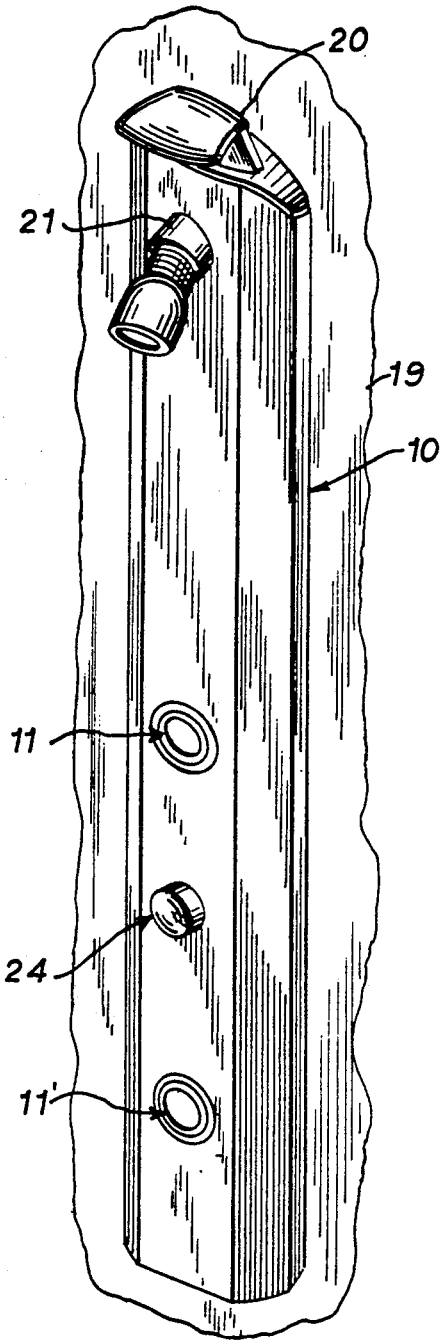
FIG. 1 is a perspective view showing a shower enclosure of this invention.
Figure 2:
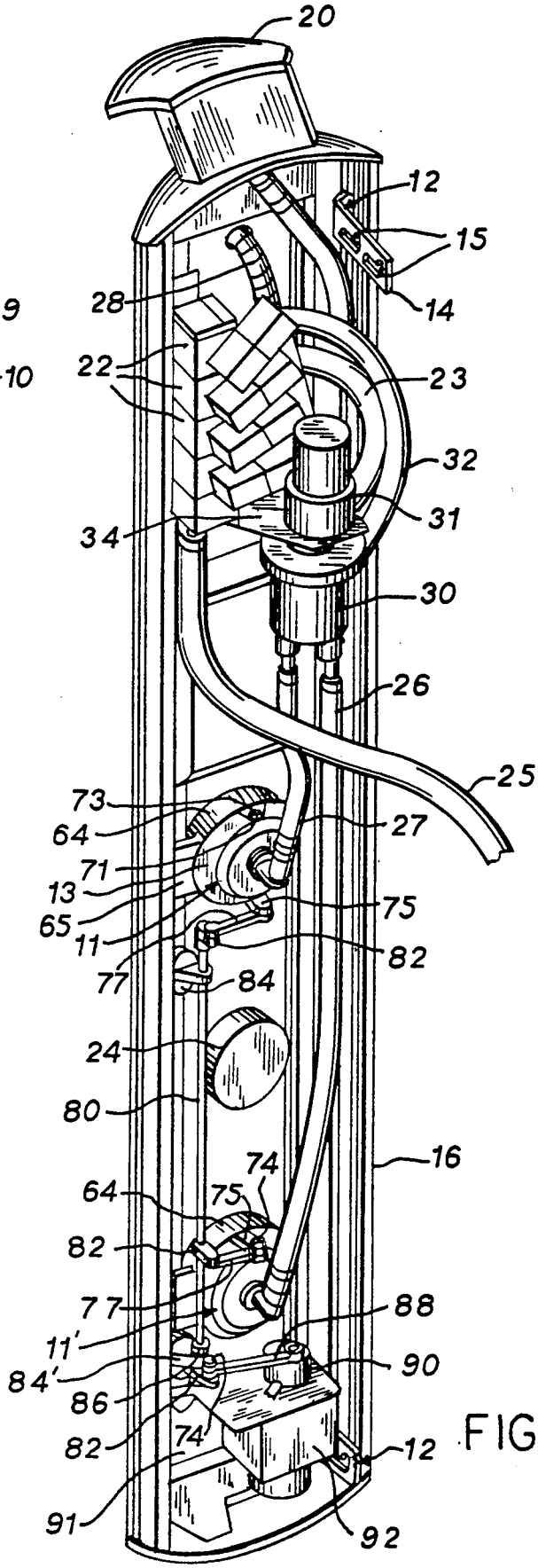
FIG. 2 is an enlarged perspective view showing the back of the enclosure shown in FIG. 1.

Referring to FIGS. 1 and 2, the shower enclosure assembly generally 10 is shown in conjunction with two spray nozzles generally 11 and 11'. As will be described more fully later, the enclosure assembly 10 is hingedly supported by two hinge members generally 12 with elongated slots 15 for mounting onto a supporting means such as a wall 19 of a shower fixture or bathing facility.

Proceeding to the top of the enclosure assembly 10, there is shown a sheet flow spout 20 as well as a spray head nozzle 21. Both the sheet flow spout 20 and the spray head nozzle are connected to a source of water by means of the mixing valve 24 which is in fluid communication with the main inlet hose 25 which in turn is connected to a bank of solenoid valves 22. These valves 22 in turn control the water to the flow spout 20 and the spray head nozzle 21 such as through hoses 23 and 28. The valves 22 also control the flow of water to a pulsating device such as indicated at 30 which is fed by the hoses 32 and 33. The pulsator 30 has an electric motor 31 and is more fully described in commonly assigned patent application entitled FLUID PULSE GENERATING APPARATUS filed Nov. 8, 1991 as U.S. patent application Ser. No. 07/790,272, now U.S. Pat. No. 5,143,121. Water is fed from the pulsator to the nozzles 11 and 11' by the hoses 26 and 27.

Figure 9:
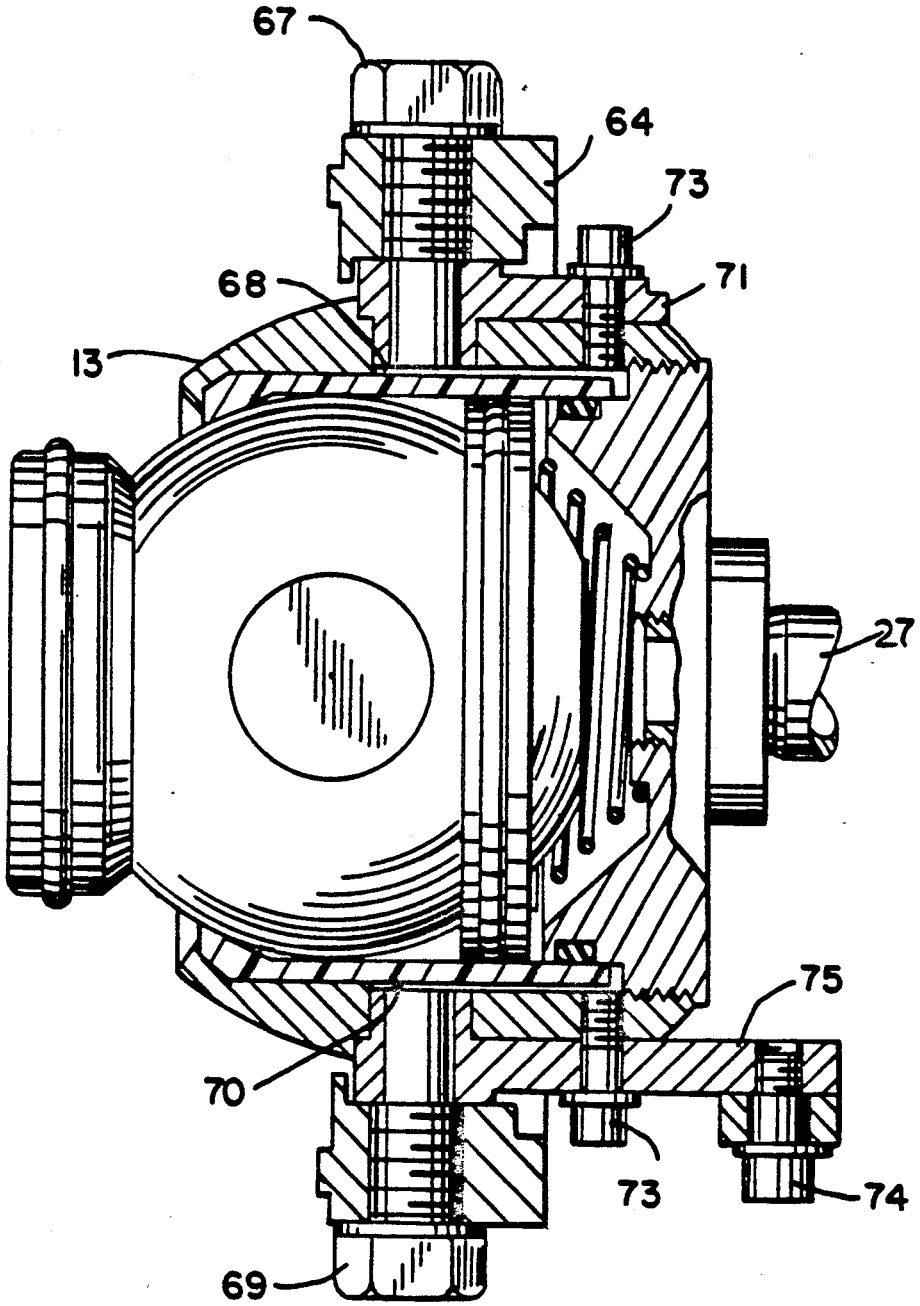
FIG. 9 is a view in partial vertical section illustrating the pivoting of the spray nozzle.

As seen in FIGS. 2 and 9, spray nozzles 11 and 11' are pivotally mounted in casing rings 64 which in turn are mounted onto the support wall or member extrusion 16 by brackets 65. Opposing pivot pins 67 and 69 are threaded in the casing ring 64 and extend into the openings 68 and 70 of the valve body 13. Upper and lower pivoted bearing surfaces are provided by the brackets 71 and 75 which are mounted onto the valve housing of each spray nozzle 11 and 11' such as by the screws 73. This is best seen in FIG. 9. The nozzles 11 and 11' are oscillated by the linkage and mechanism as set forth in commonly assigned patent application entitled BODY SPRAY NOZZLE filed Nov. 8, 1991 as U.S. patent application Ser. No. 07/790,274 U.S. Pat. No. 5,205,490. This includes brackets 71 and 75 which are connected to linkage members 77 such as by the shoulder screws 74 which in turn connect to rod member 80 by means of connectors 82 and screws such as 74. Suitable guides 84 are provided for the rod 80, and a bearing 86 which is attached to rod 80 provides for rotatable support on the lower guide member 84'. Rod 80 is interconnected to an oscillating hub 90 of an oscillating electric motor 92 through the link 88. Motor 92 is connected to extrusion 16 by the bracket 91.

Figure 3:
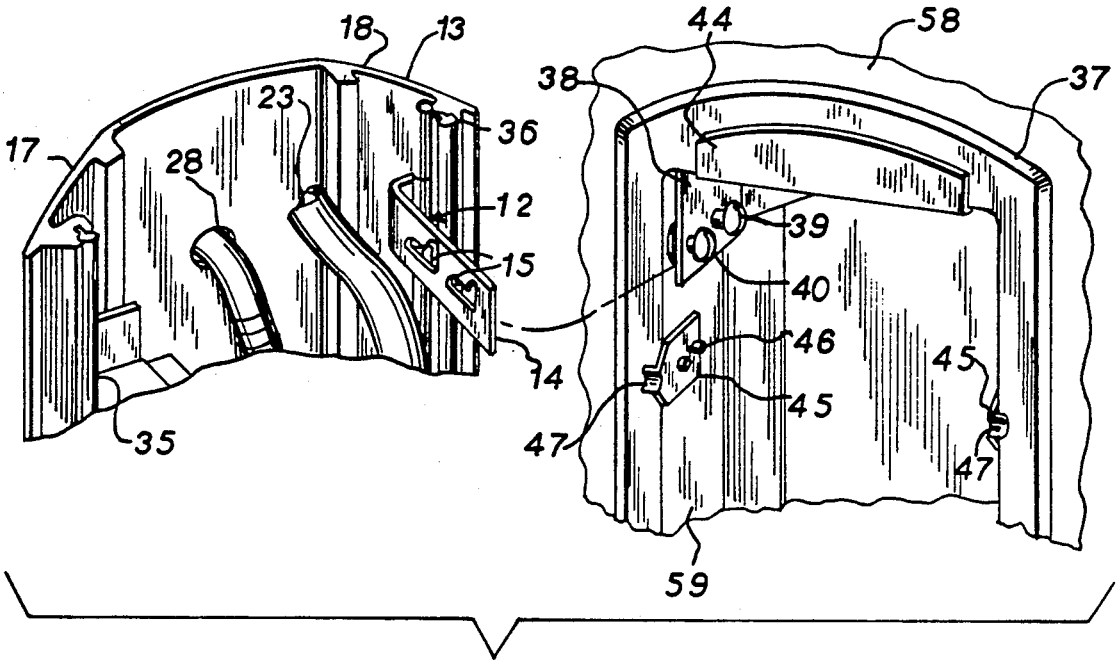
FIG. 3 is a partial assembly view showing the hinging means for the shower enclosure assembly.

Referring specifically to FIG. 3, the hinging member 12 includes a hinge plate 14 with slots 15 designed to engage hinge supports 39 and 40 which extend from a bracket 44 suitably attached to encasement 37 which is recessed in a wall as indicated at 58. The elongated slots 15 are supported over the hinge supports 39 and 40. This is best seen in conjunction with FIGS. 5–8.

Figure 4:
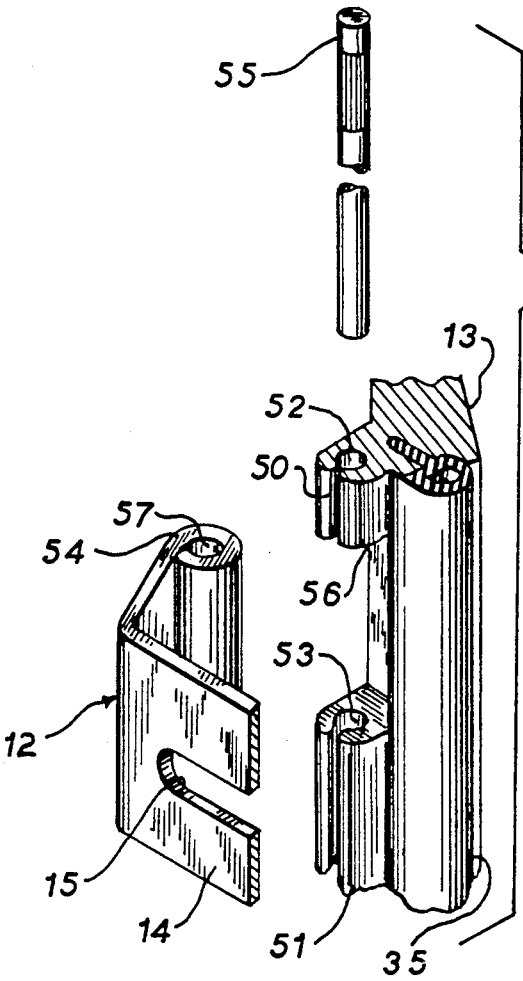
FIG. 4 is an enlarged partial assembly view showing the attachment of a hinge member to the shower enclosure assembly.

Referring to FIG. 4, the hinge member 12 is composed of the hinge plate 14 having a closed loop portion 54 and a passage 57. The closed loop portion is designed to fit in a cut out section 56 of the extrusion 13 and to be surrounded by the extending hinge portions 50 and 51. These hinge portions 50 and 51 each have passages 52 and 53 into which a hinge pin 55 is inserted when the loop portion 54 is placed in the cut out section 56 and the passages 57, 52 and 53 are aligned. It also will be noted in conjunction with FIGS. 3 and 4, that there are two seals 35 and 36 mounted in extrusion 13.

As seen in FIG. 5, the hinge supports 39 and 40 include screw heads 60 which are internally screwed to posts 61 and 63, respectively, which in turn are welded to bracket wall 38 by the weldments 62. The screw heads 60 capture the hinge plate 14 on the posts 61 and 63.

FIGS. 5 and 7 illustrate the positioning of the hinge member 12 when the shower enclosure assembly 10 is in a closed position. There it is seen that the extrusion 16 is positioned with the seal 35 and placed against the wall 59 of the encasement 37. In this instance, the hinge posts 61 and 63 of the hinge supports 39 and 40 are positioned at the extreme left side of the slots 15 as indicated by the numeral 15L. When the shower enclosure assembly is moved to an open position, the hinge member 12 is moved over the hinge posts 61 and 63 until they rest in the enlarged seating portions 48 and 49. This is illustrated in FIG. 8. In this position the extrusion 13 is moved a distance from encasement wall 59 so as to allow a pivoting of the hinge portions 50 and 51 with respect to the hinge plate 14. The extrusion can then be pivoted to a position such as shown in broken lines in FIG. 6. This position allows complete access to the rear of the extrusion for maintenance or service of the various components which are connected thereto.

It should be pointed out that the encasement 37 also serves a function in addition to providing a support for bracket 44. Encasement 37 provides an enclosure which extends toward the floor of the shower fixture 19 to direct any water which may leak from any of the components connected to the extrusion 16 to the shower floor without leaking into wall 58.

As seen in FIG. 3, there are one or more latch members 45 which are connected to the encasement by the screws 46. The latch members have a curved portion 47 for engagement by a head of a pawl (not shown) which would be mounted in the side walls 17 and 18 of the extrusion 16 in a manner well known in the art.

The preferred material for fabricating extrusion 16 is metal. However, rigid plastic could be used if desired.

It will be appreciated that a shower enclosure assembly has now been provided which permits the mounting of spray nozzles with a pulsating apparatus and oscillating means for oscillating the nozzles. The enclosure has a hinging system which permits easy access to the components in the enclosure by providing a movement of the enclosure away from a supporting wall and then a hinge open action. The hinge members also provide a positive seating of the enclosure when in an open position. Thus the invention provides an improved shower enclosure assembly.

While the preferred embodiments have been described above, it should be readily apparent to those skilled in the art that a number of modifications and changes may be made without departing from the spirit and scope of the invention. For example, while both a pulsating device and a oscillating means for oscillating the nozzles have been shown, it will be appreciated that the novel hinging feature of this invention can be utilized in conjunction with either the pulsating device or the oscillating means. Further, while a specific hinge member has been indicated for allowing an opening of the enclosure for access thereto, it will be understood that other hinging arrangements which can provide an opening of the enclosure assembly so as to afford means of access to the back thereof could also be utilized. Neither is it essential that the additional shower components such as the sheet flow spout and the spray head nozzle be utilized with the enclosure assembly.

We claim:

1. An enclosure for supporting an oscillating fluid nozzle adjacent a bathing facility wall comprising:

a support wall structure having a front and sides defining an enclosure, the support wall structure adapted to be mountable against the bathing facility wall;

a fluid nozzle pivotally attached to the support wall structure;

fluid inlet means connected to the fluid nozzle to supply fluid thereto;

oscillating means for pivoting the nozzle attached to the support wall structure;

linkage means interconnecting the oscillating means and the fluid nozzle such that the oscillating means can move the linkage means and the linkage means will in response thereto pivot the nozzle; and hinging means connected to the support wall structure for attachment to the bathing facility wall to effect an opening of the enclosure when it is pivoted away from the facility wall.

2. The enclosure support of claim 1 wherein the hinging means includes at least two plate members.

3. The enclosure support of claim 2 wherein the plate members are defined by an elongated slot with seating portions for a support pin.

4. An enclosure for supporting an oscillating fluid nozzle adjacent a bathing facility wall comprising:

a support wall having a least a front and sides providing an enclosure support mountable against the bathing facility wall;

a fluid nozzle pivotally attached to the support wall;

fluid inlet means connected to the fluid nozzle to supply fluid thereto;

oscillating means for pivoting the nozzle attached to the support wall, the oscillating means including an oscillating hub;

linkage means interconnecting the oscillating means and the fluid nozzle to pivot the nozzle, the linkage means being defined by a pivotal rod member with linkage members connecting the rod member to the nozzle and the oscillating hub; and hinging means connected to the support wall for attachment to the bathing facility wall to effect an opening of the enclosure when it is pivoted away from the facility wall.

5. An enclosure for supporting a fluid nozzle adjacent a bathing facility wall comprising:

a support wall having at least a front and sides providing an enclosure support mountable against the bathing facility wall;

a fluid nozzle attached to the support wall;

fluid inlet means connected to the fluid nozzle to introduce a fluid thereto;

pulsating means attached to the support wall and in fluid communication with the fluid inlet means to pulse fluid to the fluid nozzle; and hinging means connected to the support wall for attachment to the bathing facility wall to effect an opening of the enclosure when it is pivoted away from the facility wall.

6. The enclosure support of claim 5 wherein the hinging means includes at least two plate members.

7. The enclosure support of claim 6 wherein the plate members are defined by an elongated slot with seating portions for a support pin.

8. An enclosure for supporting oscillating fluid nozzles adjacent a bathing facility wall comprising:

a support wall having at least a front and sides providing an enclosure support mountable against the bathing facility wall;

at least two fluid nozzles pivotally attached to the support wall in a spaced manner;

fluid inlet means connected to the fluid nozzles to introduce a fluid thereto;

oscillating means for pivoting the nozzles attached to the support wall;

linkage means interconnecting the oscillating means and the fluid nozzles to pivot the nozzles;

pulsating means attached to the support wall and in fluid communication with the fluid inlet means to effect a pulsing of a fluid to the fluid nozzles; and hinging means connected to the support wall for attachment to the facility wall to effect an opening of the enclosure when pivoted away from the facility wall.

9. The enclosure support of claim 8 wherein the support wall is a metal extrusion.

10. The enclosure support of claim 8 wherein the hinging means includes at least two hinge plates and bracket members.

11. The enclosure support of claim 8 wherein the support wall further comprises an encasement member for placement in a wall and wherein the encasement member serves to direct leaking water into the bathing facility.

12. The enclosure support of claim 8 wherein the support wall is a plastic extrusion.

* * * * *

UNITED STATES PATENT AND TRADEMARK OFFICE

CERTIFICATE OF CORRECTION

PATENT NO. : 5,321,860

DATED : June 21, 1994

INVENTOR(S) : Michael D. Steinhardt et al.

It is certified that error appears in the above-identified patent and that said Letters Patent is hereby corrected as shown below:

Claim 4
Column 5, line 10 before "least" "a" should be --at--.

Claim 4
Column 5, line 22 before "members" "linkage" should be --linking--.

Signed and Sealed this

Twenty-seventh Day of September, 1994

*Attest:*

Bruce Lehman

BRUCE LEHMAN

*Attesting Officer*

*Commissioner of Patents and Trademarks*